United States Patent [19]

Colling et al.

[11] 4,022,465

[45] May 10, 1977

[54] INDOOR BOARD GAMES

[75] Inventors: Brian Colling, Bathgate; Raymond Duncan Fillingham, Milton of Campsie, both of Scotland

[73] Assignee: Dacoll Engineering Services Limited, Bathgate, Scotland

[22] Filed: Feb. 27, 1975

[21] Appl. No.: 553,626

Related U.S. Application Data

[62] Division of Ser. No. 432,459, Jan. 11, 1974, Pat. No. 3,902,723.

[52] U.S. Cl. ..... 273/1 E; 273/131 A; 340/378 A

[51] Int. Cl.[2] ..... A63F 3/00

[58] Field of Search ..... 273/131, 138, 1 E

[56] References Cited

UNITED STATES PATENTS

| | | | |
|---|---|---|---|
| 2,881,892 | 4/1959 | Ylinen | 273/138 A X |
| 3,459,427 | 8/1969 | Rhodes | 273/138 A |
| 3,709,499 | 1/1973 | Lukens | 273/138 A |
| 3,895,807 | 7/1975 | Friedman | 273/138 A |
| 3,902,723 | 9/1975 | Colling et al. | 273/131 A |

OTHER PUBLICATIONS

"Electronic Casino," published 1974, pp. 45, 50, 51, 52, 86, 58, 59 cited.

*Primary Examiner*—Delbert B. Lowe

[57] ABSTRACT

A device for playing a board game in which the players move counters over a board, the device including an electronic device automatically indicating a number of different instructions one at a time in rapid succession, a stop-go switch being provided to enable a player to stop the device with a desired instruction being indicated so that by exercising his skill the player can be successful in the game by obtaining a series of desired instructions. A further device may be provided for a competing player to interfere by changing the instruction indication at random.

4 Claims, 4 Drawing Figures

+6V
IC1
7400
IC2
7400
IC3
7400
MV
5425
R1
R2
R3
R4
R7
D1
T1
T2
C
R
E
P
T
A
B
C
D
2
3

INDOOR BOARD GAMES

This is a continuation, division, of application Ser. No. 432,459, filed Jan. 11, 1974, now U.S. Pat. No. 3,902,723, issued Sept. 2, 1975.

This invention relates to board games and in particular to a board game where the success of a player in that game is dependent on the speed of the player's reactions.

According to the present invention there is provided means for providing a test of skill for a player, said means including a device having electronic circuitry, an array of indicators and a stop-go switch connected to the electronic circuitry which is, in turn, connected to said array and arranged to control the array so that the array makes respective indication signals one at a time in automatic succession during operation of the device, said stop-go switch being operable by a player to halt the automatic change of indication signals by said array so that the array will hold one of the indication signals dependent upon when the player operates the stop-go switch.

Preferably there is provided with the device a board having depicted on it a number of stations or areas including at least one start position and one finish position, the other areas or stations providing a plurality of combinations forming routes by which a counter may be moved in steps from the start position to the finish position, the successive instructions indicated by the device to a player determining successive steps of a route for a counter starting from the start position.

Figures 1A, 1B, 1C:
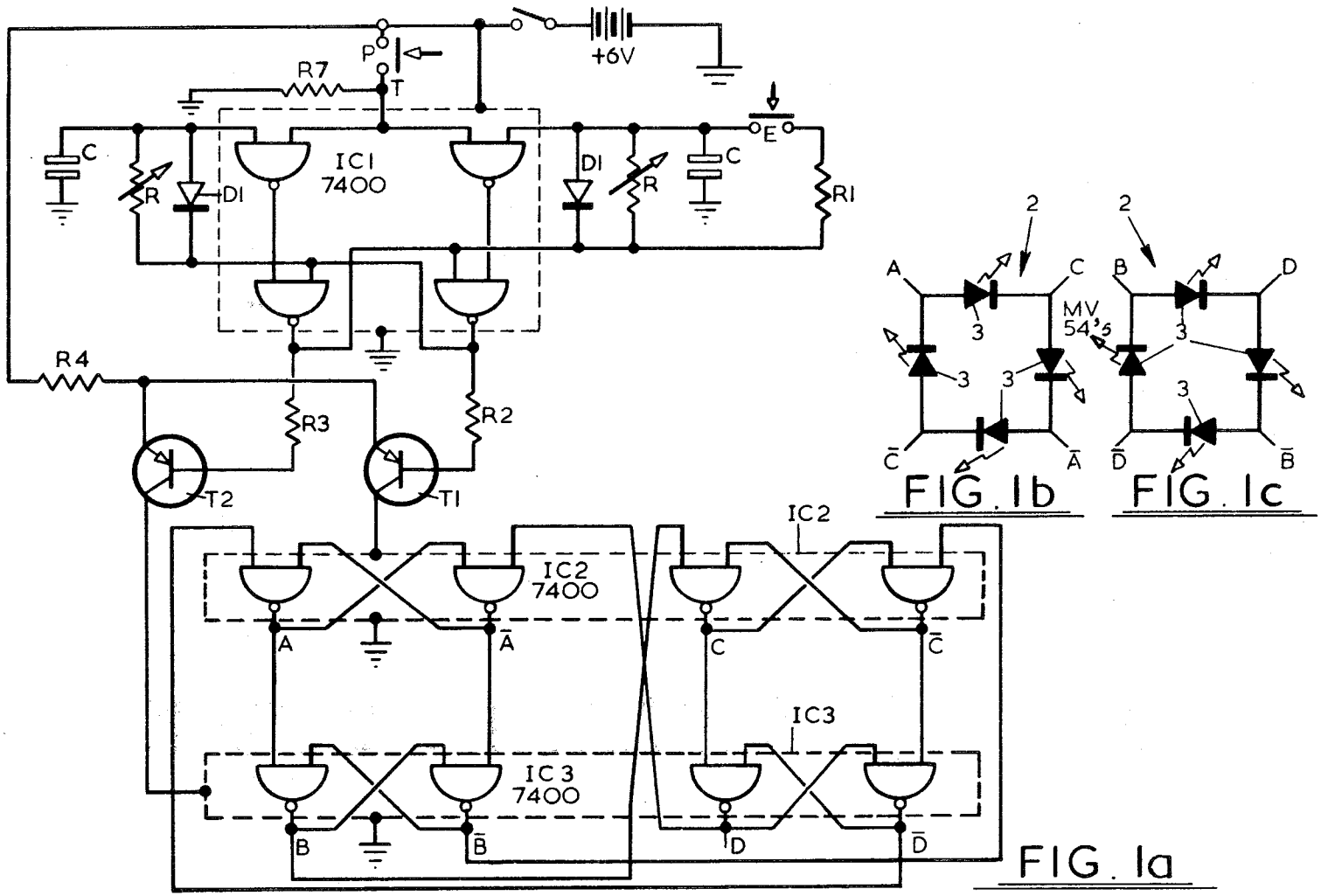
Figure 2:
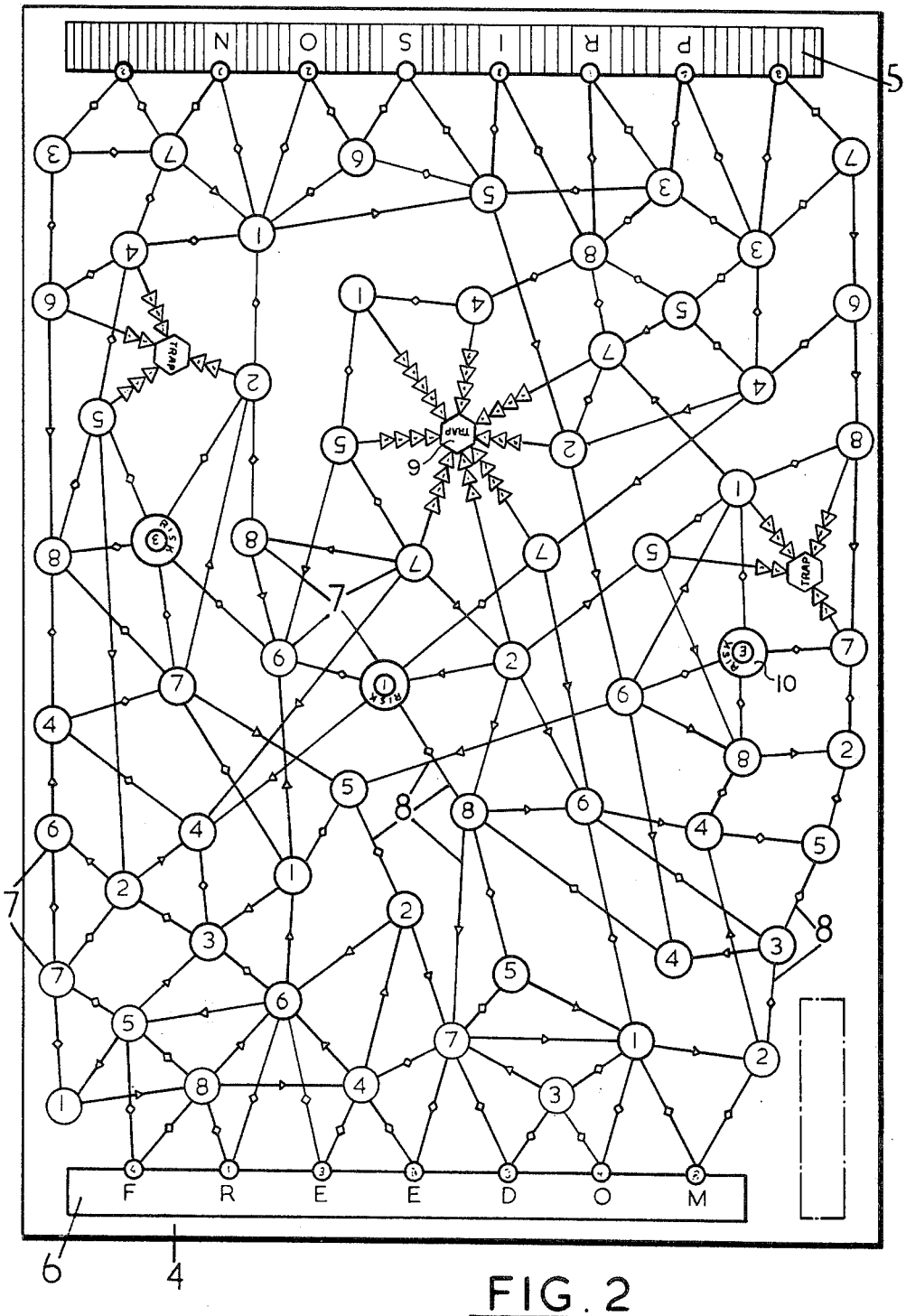

An embodiment of the present invention will now be described, by way of example only, with reference to the accompanying drawings in which:

FIG. 1*a* is a circuit diagram of the electronic means for controlling an array of lights forming indicators of a device according to this invention:

FIGS. 1*b* and 1*c* are respective circuit diagrams illustrating the connections of two sets of lights, forming the array, to the electronic means shown in FIG. 1*a;* and FIG. 2 is a plan view of a board used in playing one form of game in which the device shown in FIG. 1 can be used.

Referring to the drawings, means for playing a game comprise a device having electronic means for controlling an array 2 of lights 3 in the form of light emitting diodes, and a board 4 having a start position 5 and a finish position 6 between which are distributed areas or stations 7 and a plurality of lines 8 indicating possible paths of travel between stations. Each station has an associated number corresponding to one of the lights 3 so that a player whose counter is upon one of the stations and who obtains an instruction from the array 2 in the form of a number between 1 and 8 must move his counter to another station having the number corresponding to his instruction if this is possible by travelling along only one of the lines radiating from his present station. If no such route is possible, the player keeps his counter where it is for that turn.

In the illustrated example the start position 5 represents a "prison" from which some players are to escape and the finish position 6 represents "freedom" from which the other players, acting as "policemen", start and proceed to move into stations 7 in such a way as to intercept the escaping "prisoners". Capture of a prisoner takes place when the counter representing the prisoner is on the same station as one of the "police" counters. Various "TRAP" stations 9 are provided which serve to "capture" prisoner counters which land on them. Various scoring systems may be adopted to determine a winner. Also various "RISK" stations 10 are provided where a player may land and then has to take a risk, for example, by having to operate the instruction indicating device when the array 2 is covered to conceal the lights 3 from him.

Referring to FIG. 1*a* the electronic means includes a multivibrator comprising four interconnected NAND gates formed as a conventional integrated circuit IC1 to which are connected two delay circuits each comprising a capacitor C having one plate connected to earth, a presetable resistor R and a diode D1. One of the delay circuits is additionally provided with a series arrangement of a resistor R1 and a push button switch E connected in parallel with the resistor R of the delay circuit. It has to be noted that the multivibrator is so arranged that it can stop with its outputs in either of the two possible combinations of states.

The integrated circuit IC1 has two outputs connected via respective resistors R2 and R3 to respective bases of transistors T1 and T2. Each of these transistors has its emitter connected via a common resistor R4 to the positive terminal of a 6 volt supply.

The collectors of the transistors T1 and T2 are connected to respective conventional integrated circuits IC2 and IC3 each containing four NAND gates. The NAND gates of each of the circuits IC2 and IC3 are arranged as two bistables each comprising a pair of interconnected NAND gates. The signals received from the collectors of the transistors T1 and T2 provide effective clock pulses for the circuits IC2 and IC3, respectively. The circuits IC2 and IC3 provide eight output signals A, $\overline{A}$, B, $\overline{B}$, C, $\overline{C}$, D, $\overline{D}$, which are connected to the array of lights 3 in the manner illustrated in FIGS. 1*b* and 1*c*.

The outputs of the bistables in the integrated circuit IC2 or IC3 are connected to the inputs of respective associated ones of the bistables in the circuit IC3 or IC2, respectively, to form a series connected loop of bistables. The outputs A $\overline{A}$, B $\overline{B}$, and C $\overline{C}$, are all connected in the same way to their associated succeeding bistables in the series but the outputs D $\overline{D}$ are connected the opposite way around to the NAND gates forming the A $\overline{A}$ bistable. Thus, as will be clear to one skilled in the art, it will require a total of eight clock pulses from transistors T1 and T2 to produce the eight different combinations of outputs from the integrated circuits IC2 and IC3.

The electronic means is powered by a battery connected via an ON-OFF switch and the multivibrator is set into operation by means of a push button stop-go switch P which connects the positive terminal of the battery to an input terminal T of the multivibrator. When the switch P is open the terminal T is earthed via a resistor R7.

In operation after the switch has been closed to connect the power supply to the electronic means the stop-go switch P is closed to set the device in cyclic operation. The multivibrater starts to cycle to produce two pulsed outputs having an even mark-space ratio and being almost 180 degrees out of phase, with the small overlap determined by the reaction time of the integrated circuit IC1.

The outputs from the multivibrator trigger the transistors T1 and T2 which deliver their respective clock pulse signals to the circuits IC2 and IC3. Thus the circuits IC2 and IC3 are switched ON and OFF alternately so that one of the lights 3 is lit in the arrangements shown in FIGS. 1*b* and 1*c* alternately. When the switch P is then opened the cyclic operation ceases and a light 3 is left in its lit condition. Which of the lights is so left depends on when the switch P is opened.

Which of the lights 3 is lit depends on the Boolean values that can be ascribed to the outputs A, $\overline{A}$, B, $\overline{B}$, C, $\overline{C}$, D, $\overline{D}$, at any one time, i.e. if (using positive logic) the output A has Boolean value 1 and the output C the value 0 then the diode between the outputs A and C will light. In this latter situation it is clear that the outputs $\overline{A}$ and $\overline{C}$ have values 0 and 1 respectively so that none of the other light-emitting diodes shown in FIG. 1*b* can light because of their diode properties, i.e., all the other, unlit diodes are reverse biased. None of the diodes shown in FIG. 1*c* is lit at the same time as the diode between the outputs A and C because the integrated circuit IC3 is switched OFF for almost the entire time that the circuit IC2 is ON since, as mentioned above, there is an almost 180° degree phase shift between the signals from the transistors T1 and T2. The small overlap, also mentioned above, is sufficient for the cyclic operation of the integrated circuits but is too small to be apparent in the lighting up of the diodes.

It will be clear to one skilled in the art that the cyclic operation is such that all the lights 3 will light in predetermined succession during one cycle. Thus it will be possible for a player to memorize the lighting order of the lights and if his reactions are quick enough he can obtain a favorable instruction using his skill in operating the switch P to stop the cyclic operation at an instant when a selected light 3 will remain lit.

A further element of skill is exercisable by the player's opponent since, by operation of the switch E, he can vary the mark-space ratio of the outputs from the circuit IC1. When the switch E is closed the delay characteristics of the multivibrator circuit arrangement are altered since one of the delay circuits then has resistor R1 connected into its circuit. The rules of the game can provide for permission for the opponent to operate the switch E only in particular circumstances.

If the players find that the cyclic operation is too slow they can speed it up by suitable adjustment of the resistors R. By suitable adjustment of resistors R the mark-space ratio can be biased to give uneven lighting periods of the two sets of lights 3.

Clearly the electronic means shown in FIG. 1a can be modified. One example of such modification is to replace the circuit IC1 by a similar circuit capable of greater power output so that the transistors T1 and T2 can be omitted and the outputs of the first integrated circuit can be connected directly to the circuits IC2 and IC3. Also the lights 3 may be incandescent bulbs but this would use considerably more power than the light-emitting diodes.

What we claim is:

1. Means for providing a test of skill for a player, said means including a device having cyclic triggering means, automatic switching means, logic gates of the automatic switching means, respective outputs of the logic gates, an array of light-emitting diodes and a stop-go switch connected to the cyclic triggering means which is, in turn, connected to the automatic switching means in which the logic gates are interconnected, the light-emitting diodes being connected between logic gate outputs of respective combinations of the logic gate outputs and the cyclic triggering means being arranged to trigger the automatic switching means so that said combinations of logic gate outputs provide signals lighting their respective light-emitting diodes one at a time in automatic succession, said stop-go switch being operable by the player to halt the triggering by the cyclic triggering means so that one only of the combinations of logic gate outputs remains in a state such as to light its associated light-emitting diode to provide a visual indication signal dependent on the player's skill in operating the stop-go switch.

2. Means according to claim 1, wherein the cyclic triggering means comprises a multivibrator having two outputs and the logic gates and the associated light-emitting diodes are arranged as two interconnected groups connected to the respective outputs of the multivibrator and arranged to be triggered alternately by the multivibrator.

3. Means according to claim 2 wherein means are provided for pre-setting the mark/space ratio of the two output signals of the multivibrator and an interference switch and associated circuit are connected into the multivibrator and are operable to change the pre-set mark/space ratio in a predetermined manner so that operation of the interference switch by one player can disturb the timing of the occurrence of an indication signal required by the player operating said stop-go switch.

4. Means according to claim 1, wherein connections are provided between the outputs of the logic gates and selected inputs of the logic gates to obtain said automatic switching of the outputs to light the light-emitting diodes one at a time in automatic succession.

* * * * *